United States Patent [19]

Krenzer

[11] Patent Number: 5,054,174

[45] Date of Patent: Oct. 8, 1991

[54] METHOD OF PRODUCING AN AIR TEXTURED YARN

[75] Inventor: Eberhard Krenzer, Ennepetal, Fed. Rep. of Germany

[73] Assignee: Barmag AG, Remscheid, Fed. Rep. of Germany

[21] Appl. No.: 399,599

[22] Filed: Aug. 28, 1989

[30] Foreign Application Priority Data

Dec. 13, 1988 [DE] Fed. Rep. of Germany ..... 3841837
Jan. 11, 1989 [DE] Fed. Rep. of Germany ..... 3900568

[51] Int. Cl.[5] ..... D02G 1/16; D02J 1/08
[52] U.S. Cl. ..... 28/271; 28/273
[58] Field of Search ..... 28/271, 273

[56] References Cited

U.S. PATENT DOCUMENTS

| | | | |
|---|---|---|---|
| Re. 32,047 | 12/1985 | Krenzer . | |
| 3,069,836 | 12/1962 | Dahlstrom et al. . | |
| 3,435,171 | 3/1969 | Lohest . | |
| 3,448,501 | 6/1969 | Buzano . | |
| 3,487,187 | 12/1969 | Martens et al. . | |
| 3,558,760 | 1/1971 | Olson | 28/271 |
| 3,772,872 | 11/1973 | Piazza et al. . | |
| 3,892,020 | 7/1975 | Koslowski . | |
| 4,026,099 | 5/1977 | Phillips | 28/273 |
| 4,043,010 | 8/1977 | Gorrafa | 28/271 |
| 4,297,837 | 11/1981 | Bauer et al. . | |
| 4,341,063 | 7/1982 | Southerlin et al. | 28/271 |
| 4,467,594 | 8/1984 | Eshenbach | 28/271 |
| 4,501,046 | 2/1985 | Krenzer . | |
| 4,557,689 | 12/1985 | Krenzer . | |
| 4,608,814 | 9/1986 | Moore, Jr. et al. . | |

FOREIGN PATENT DOCUMENTS

| | | |
|---|---|---|
| 0024695 | 8/1980 | European Pat. Off. . |
| 0032067 | 7/1981 | European Pat. Off. . |
| 0284945 | 3/1988 | European Pat. Off. . |
| 0295601 | 12/1988 | European Pat. Off. . |

*Primary Examiner*—Werner H. Schroeder
*Assistant Examiner*—Bibhu Mohanty
*Attorney, Agent, or Firm*—Bell, Seltzer, Park & Gibson

[57] ABSTRACT

A method and apparatus for producing an air textured yarn is disclosed, and wherein a partially oriented yarn is withdrawn from a supply package, drawn, and then directly advanced into an air texturing nozzle, wherein a jet of unheated air serves to impart loops, curls, bows and the like to the advancing yarn. The drawing godet of the drawing system is heated so as to heat the advancing yarn, and the yarn is then advanced from the heated godet to the air jet nozzle under a relatively low tension so as to permit the heated yarn to shrink and thereby reduce the residual shrinkage. The jet is unheated air in the air jet nozzle also cools the yarn ahnd thus the formation of the loops, etc. occurs only after shrinkage has ceased.

18 Claims, 3 Drawing Sheets

METHOD OF PRODUCING AN AIR TEXTURED YARN

BACKGROUND OF THE INVENTION

The present invention relates to a method and apparatus for producing an air textured yarn having a relatively low residual shrinkage.

Methods and apparatus are known from German Patent 32 10 784, in which the yarn to be textured is supplied as a preoriented, thermoplastic yarn. The yarn is drawn in a draw zone and subsequently extended in an air nozzle to form loops, curls, bows and the like. The yarn produced has a residual shrinkage. In the scope of the present application, the phase "residual shrinkage" is intended to mean the tendency (shrinkage tendency) of the yarn to shrink when being heated, for example, by hot air or hot water.

Shrinkage is a shortening of the yarn, which occurs in fact when it is heated, and which is expressed by the formula $(L1-L2)\times 100/L1\%$, with L1being the original and L2 the shortened length of the yarn. The shrinkage cannot be greater than the previously existing residual shrinkage. However, a residual shrinkage can still remain despite the shrinkage.

If the known method is applied, the residual shrinkage, i.e. the tendency to shrink can be reduced only by a suitable aftertreatment subsequent to the process. Although it is possible to reduce the residual shrinkage of the yarn by such measures for aftertreatment of the shrinkage, these measures, however, have considerable disadvantages. This applies particularly to textured yarns, since the aftertreatment subsequently affects or even damages the crimp. Primarily, a shrinkage treatment can be carried out intensively only when the yarn is subjected to "contact heating," i.e. when the yarn passes over a hot plate of a heated godet. However, this procedure is generally not suitable for textured yarns, because it results in an ironing effect. This means that a previously imparted yarn texture is again removed in part, primarily on one side of the yarn, by its contact with the hot surface.

A method of aftertreatment for the purpose of reducing the shrinkage of an air textured yarn is known from U.S. Pat. No. 3,892,020 which corresponds to DE-OS 23 59 102. In this process, the air textured yarn is wound onto a very soft package under little tension of less than 0.4 grams/denier. This package is subsequently dyed in a heated dye liquor. As a result thereof a shrinkage is started, and the residual shrinkage remaining in the yarn is reduced accordingly. However, this method is not adapted to carry out the treatment for reducing the residual shrinkage on an air texturing machine. Particularly disadvantageous is that the package must be wound under a low yarn tension, which adversely affects the transportability of the package. Furthermore, the package and the yarn are damaged by the increased yarn tension, which builds as the shrinkage becomes effective.

The residual shrinkage can also be reduced prior to texturing. To this end, it is known that a thermoplastic drawing process of thermoplastic yarns can be followed by a treatment for reducing shrinkage in a relaxation zone. The relaxation zone follows the actual draw zone, and is formed between two godets or feed systems, with the yarn being heated in the relaxation zone. As a result thereof the length of the yarn path and thus the height of the air texturing machine is necessarily increased.

Primarily, however, this relaxation treatment will always result in the problem that the reduction of the shrinkage in such a relaxation zone has its limits, inasmuch as the tension of a yarn traveling between godets cannot be reduced to any desired extent, and consequently the shrinkage is dependent on the limited speed difference of the godets.

The above is based on the fact that a yarn must always advance in a straight line between two feed systems and consequently be under a certain minimum tension. The shrinkage which occurs in fact results from the state of equilibrium between the shrinkage tendency on the one hand and the yarn tension on the other.

A method of reducing residual shrinkage, in which a multifilament yarn is simultaneously interlaced or entangled, is disclosed in U.S. Pat. No. 3,069,836. In this method, the yarn, which is first drawn between two godets assisted by an unheated draw pin, passes through a relaxation zone, in which the entry speed is greater than the exit speed. While in the relaxation zone, the yarn passes through a nozzle, which is supplied by a heated gas. The shrinkage which is this accomplished is, as aforesaid, dependent on the difference of these speeds. The application of hot air serves both to produce a shrinkage and to make a yarn which has its filaments entangled. The method is not suitable for producing a crimp, because it will produce a yarn whose filaments are chemophysically changed in their inner structure by the action of heat during the air texturing operation. Even if curls and loops were produced in the filaments, such a crimp of this yarn would not be stable. This means that this crimp would again be removed from the yarn by the application of tensile forces. Tensile forces, which suffice to remove this crimp, however, occur already as a result of the shrinkage in the relaxation zone, as well as also during the aftertreatment by subsequent stabilizing and heat setting processes, which are provided, according to U.S. Pat. No. 32,047, for improving the length stability of the yarn, and in particular in weaving and knitting. As a result, such a yarn would not be usable as a crimped yarn.

An air texturing method in the meaning of the present application is understood to be a method, in which a continuous, synthetic yarn, which comprises a plurality of individual filaments, is subjected to the action of an air texturing nozzle. In the air texturing nozzle, an unheated air jet is blown onto the yarn. As a result, the individual filaments are deformed to loops, curls, bows or the like without thereby substantially changing the chemophysical structure of the filaments. The filaments extending substantially parallel at first are only geometrically relocated in an irregular form, thereby forming in particular loops, curls and bows. A particularly suitable method of producing high-quality yarns is disclosed in German Patent 27 49 867 and corresponding U.S. Pat. No. 32,047. Suitable nozzles are shown in the dissertation "Die Texturierung von Filamentgarnen im Luftstrom" by Bock, Aachen 1984/1985.

It is accordingly an object of the present invention to efficiently produce an air textured yarn, which is low in shrinkage, i.e., has little residual shrinkage.

SUMMARY OF THE INVENTION

The above and other objects and advantages of the present invention are achieved in the embodiments illustrated herein by the provision of a method and apparatus for producing an air textured yarn and which includes the steps of advancing a continuous filament yarn along a path of travel, and drawing the advancing yarn in a drawing zone positioned along the path of travel. The drawing step includes guiding the advancing yarn into contact with a yarn engaging member and then about a positively rotated godet which serves to withdraw the advancing yarn from the yarn engaging member and draw the same. Also, the drawing godet is heated so as to heat the yarn to a temperature which is higher than the second order transition temperature of the yarn. The advancing yarn is guided from the heated godet to an air jet nozzle while permitting the heated yarn to shrink and thereby reduce the residual shrinkage, and a jet of unheated air is applied to the advancing yarn while passing the advancing yarn through the air jet nozzle and so as to impart loops, curls, bows and the like to the advancing yarn. Also, the unheated air acts to cool the yarn to a temperature below the second order transition temperature of the yarn. The advancing yarn is then withdrawn from the air jet nozzle, and wound into a package.

The present invention permits the residual shrinkage to be reduced to a much greater extent than in the above noted known methods. A special advantage of the invention is that texturing is not adversely affected. Of particular importance in this regard is that an intensive heating of the yarn occurs. Consequently, the yarn can be heated to a temperature above the second order transition temperature of the yarn, so that the crystalline structure, which is firmly anchored up to this temperature, softens and inner tensions diminish. On the other hand, however, the yarn is cooled in the air texturing nozzle to a very great extent, so that shrinkage is stopped and texturing occurs on the cold yarn.

The present invention represents a fortunate integration of the relaxation process into the air texturing process. The yarn is heated at the outlet end of the draw zone, and an intensive heating can be achieved by utilizing a heated godet in the drawing zone as described above. Also, very low yarn tensions in the texturing zones, and thus a good shrinkage effect, can be achieved.

In comparison with yarns which are treated by the described known methods of reducing residual shrinkage, the tendency to residual shrinkage of the yarns treated according to the present invention is less than half. This results from the fact that the method of the present invention does not have the aforesaid limitations of the known processes because, according to the present invention, the shrinkage to be adjusted is not dependent on the speed difference in the relaxation zone (entry speed less exit speed), and the yarn tension does not increase as a result of the occurrence of the shrinkage. Rather, the yarn tension to be adjusted and thus also the shrinkage are based alone on the tensile force of the air texturing nozzle.

In the preferred embodiment, the yarn is withdrawn from the heated godet by the air texturing nozzle under a tension of less than about 0.1 cN/dtex, and removed from the air texturing nozzle under a tension of less than about 0.05 cN/dtex. These low yarn tensions of the texturing zone are differently adjusted before and after the air texturing nozzle. In so doing, the yarn may be considerably deflected at the outlet end of the air texturing nozzle, preferably of about 90°. This deflection is novel as compared to the usual straight yarn path in the entangling process, and it is readily possible with air texturing nozzles.

The heat and shrinkage treatments of the present invention allow for any inadequacies or shortcomings of the preceding draw process to be overcome. More specifically, with the present invention it becomes possible to draw polyester yarns with an unheated draw pin, which so far has been possible only with nylon 6.6 yarns. Since the heat and shrinkage treatments occur prior to the texturing, inadequacies or shortcomings of the drawing process can no longer produce irregularities in the texturing result. Consequently, the present invention has the further benefit of reducing the expenditure for process and mechanical engineering to obtain a good, regular drawing, and of selectively texturing nylon 6.6 or polyester yarns, textile or industrial yarns on one machine without a change.

With the present invention, it thus becomes possible to draw the yarn by the sensible heat developing in the drawing operation, thereby eliminating already prior to the actual texturing operation any irregularities of the drawing process, which otherwise occur in such a process, by the subsequent intensive shrinkage treatment. It is thus possible to produce yarns having a great strength and the desired properties with regard to elongation and residual shrinkage.

The method of the present invention is particularly suitable for drawing and air texturing preoriented yarns, in particular polyester yarns (note U.S. Pat. No. 3,772,872).

The yarn tension decisive for the shrinkage is generated by the tensile force of the texturing nozzle. The tensile force of the texturing nozzle is again dependent on the speed of the yarn. The yarn speed is determined by the circumferential speed of the draw roll, which precedes the texturing nozzle. The difference between the circumferential speed of the draw roll and the feed system subsequent to the texturing nozzle is not decisive for the shrinkage because, according to the present invention, this difference is always greater than the amount of the desired shrinkage. The latter is defined alone by the tensile force of the nozzle and by the influence of the temperature of the draw roll. Stated otherwise, the overfeed of the yarn in the texturing zone is always greater than the shrinkage adjusted by the tensile force of the nozzle and the temperature of the draw roll. Thus, the overfeed $O=(v5-v10)\times 100:v10$, with $v10$=circumferential speed of the feed system subsequent to the texturing nozzle; and $V5$=circumferential speed of the draw roll. The shrinkage is expressed by the equation $S=(L1-L2)\times 100:L1$, with $L1$=original length of the yarn; and $L2$=length of the yarn after the shrinkage.

As a result of the fact that the overfeed is greater than the adjusted shrinkage, it is accomplished that the yarn can be crimped in the desired manner. The difference between overfeed and adjusted shrinkage is typically about 1–10% for industrial yarns, in which texturing serves in particular the purpose of roughening the yarn, so as to improve, for example, its running capability (sewing threads) or its adhesion to other materials (industrial fabrics, tire cord).

The difference between overfeed and adjusted shrinkage ranges from about 10% to 300% for textile yarns. What matters in the case of textile yarns is to influence appearance, touch, bulkiness and other properties in such a manner as is desired for clothing and other textile uses.

As a result of the present invention, it becomes possible to design and construct the air texturing machine, despite the additionally installed means for reducing the residual shrinkage, in a more simple manner and with a lesser overall height than previous standard air texturing machines, which do not offer the possibility of reducing the residual shrinkage.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
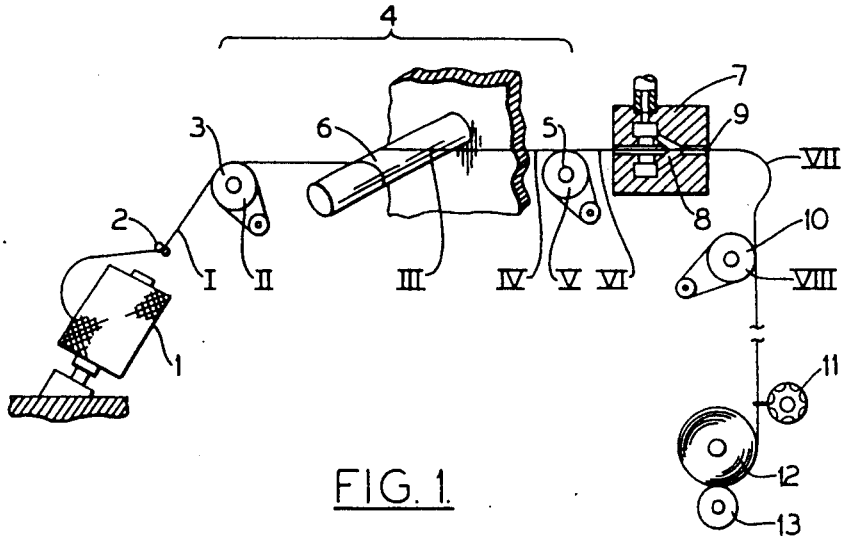
FIG. 1 is a schematic view of an apparatus for producing an air textured yarn in accordance with the present invention.

Referring more particularly to the drawings, FIG. 1 discloses an apparatus for practicing the present invention and wherein a preoriented yarn is unwound by a first feed system 3 from a supply package 1 over a yarn guide 2, and passes through a draw zone 4, whence it is withdrawn by a draw system (draw roll) 5. In the draw zone 4, the yarn is guided over a heatable draw pin 6 with a looping of 360°. Behind the draw roll 5, the yarn passes through an air texturing nozzle 7, which is supplied with unheated compressed air, and so that the yarn is cooled to an extent that shrinkage comes to a standstill. Thus when the yarn undergoes an air texturing treatment, it is not heated to its deformation point. Consequently, the deformations generated by the air jet treatment do not affect the chemophysical structure of the yarn. Upon its impact on the yarn, the air expands and consequently cools down further. As the air jet expands, the individual filaments of the multifilament manmade yarn are blown to loops, curls, bows, and the like. These geometrical deformations, which interlace and entangle, thereby form the texture of the yarn.

It should be emphasized that the air, which is supplied to the texturing nozzle, is unheated and has a temperature which is less than the temperature at which the crystalline structure of the yarn freezes, and consequently any shrinkage comes to a standstill. Normally, the air temperature is below 40° C. As the air expands, it is cooled further, and the air which leaves the nozzle has a temperature of less than 10° C. Taking into account that the texturing nozzle is operated by compressed air under a pressure of between 6 and 10 bar, the yarn previously heated by the draw roll is likewise considerably quenched in the texturing nozzle so that its temperature also drops below the temperature at which its crystalline structure freezes. Consequently, it should be understood that the yarn is cooled by the air texturing nozzle, thereby bringing the shrinkage to a standstill. This has the advantage that texturing by the formation of the loops, curls, bows and the like occurs only when shrinkage has come to a standstill. Consequently, texturing is no longer affected or influenced by the shrinkage. This is very significant, inasmuch as the production of an air textured yarn with a good length stability after texturing makes it necessary to first exert a tensile force on the yarn before the latter is compacted by subsequent further heat and shrinkage treatments. To this extent, reference is made to the above noted German Patent 27 49 867 and corresponding U.S. Pat. No. 32,047. As a result, the method of the present invention is a significant supplement to the known method.

As is schematically indicated in FIG. 1, the air channels 8, which are directed in the texturing nozzle 7 to a yarn channel 9, have a directional component in the direction of the yarn path. This allows the air texturing nozzle 7 to also exert an advancing effect and a tensile force on the yarn. The yarn leaves the air texturing nozzle 7 substantially under no tension, and the yarn is then deflected and guided to a feed system 10. The deflection ranges from 30° to 90°, preferably 90°, and is accomplished in that the feed system 10 does not extend along the axis of the yarn channel 9, but is laterally displaced therefrom. Consequently, the deflection does not occur by reason of the yarn traveling over a yarn guide, but rather the yarn leaving the air channel first continues to be advanced by the air jets in a straightline and must then change its direction toward the feed system 10. This type of deflection results in a substantial decrease of the yarn tension. Consequently, the yarn tension is higher between the draw roll 5 and the texturing nozzle 7 than the yarn tension, which increases again behind the texturing nozzle 7 after the deflection and before the feed system 10. The yarn tensions before and behind the air texturing nozzle amount, for example, to 6 cN and 5 cN.

Located downstream the feed system 10 is a suitable yarn treatment means, such as is particularly known from German Patent 27 49 867 and corresponding U.S. Pat. No. Re. 32,047. More specifically, the yarn can be drawn in a stabilizing zone between two godets without any elastic or plastic deformation and without being heated. Alternatively or preferably subsequent to the stabilization, the yarn can be guided through a setting zone at temperatures up to 245° C. The successive arrangement of a stabilizing zone and a setting zone results in a particularly compact yarn of little instability. Subsequently, the yarn is reciprocated transversely to its direction of advance by a traversing mechanism 11, and wound on a package 12. The package 12 is driven by a friction roll 13 at a constant circumferential speed.

According to the invention, the draw roll 5 is heated. It should be emphasized that the temperature of the draw roll 5 is higher than the temperature of the draw pin 6. When drawing and relaxing polyester and polyethylene terephthalate yarns the temperature of the draw roll 5 is about 200°–245° C. When the draw pin 6 is heated, its temperature ranges from about 80° to 140° C.

In the case of polyamide yarns, i.e., nylon and perlon yarns, a cold drawing is possible in accordance with normal practice. In so proceeding, the yarns are looped about a draw pin, which is not supplied with heat from an external source. The method of the present invention makes it possible to eliminate entirely the heating of the draw pin 6 also in the case of polyester. In so doing, temperatures ranging from 80° to 140° develop automatically in the yarn as a result of the drawing. The use of an unheated draw pin is also possible, in particular when high draw ratios, which are significantly above the yield point of the yarn, are applied by a corresponding adjustment of the circumferential speeds of the feed system 3 on the one hand and draw roll 5 on the other.

In a test, a preoriented yarn of 295 dtex was drawn between the godets 3 and 5. The speed of godet 3 was 205 meters per minute, and that of godet 5 was 400 meters per minute. Godet 5 was heated to 240°. Beforehand, the yield point of the yarn was determined at a drawing of 1.95. A yarn of 159 dtex was produced with a breaking strength of 4.6 cN/dtex, an elongation of 21% and a TESTRITE TM shrinkage of O. A hot air shrinkage was determined at 1.4%. Then, the draw ratio was reduced, and the same test was conducted with the speed of godet 3 having been 216 meters per minute. The result was a 167 dtex yarn with a breaking strength of 2.5 cN/dtex, a breaking elongation of 9.7% and a TESTRITE TM shrinkage of 0.5%

The above results show that an adjustment of the draw ratio permits the yarn properties to be significantly regulated, in particular the breaking strength, breaking elongation and residual shrinkage. The adjustment of the draw ratio and the temperature of the draw roll 5 makes it possible to produce yarns with very different properties, in particular, breaking strength, breaking elongation, residual shrinkage, even with the use of a nonheated draw pin. Consequently, the present invention makes it possible to use one and the same texturing machine without modification for the production of different yarns. In particular, it becomes possible to produce industrial and textile yarns with one and the same machine. Industrial yarns include such yarns as are used for industrial purposes, such as, for example, sewing thread, reinforcement yarns for webs of fabric, plastic sheets, rubber sheets, and tire cord. Textile yarns are in particular those, which serve directly the human use, in particular clothing.

Figure 2:
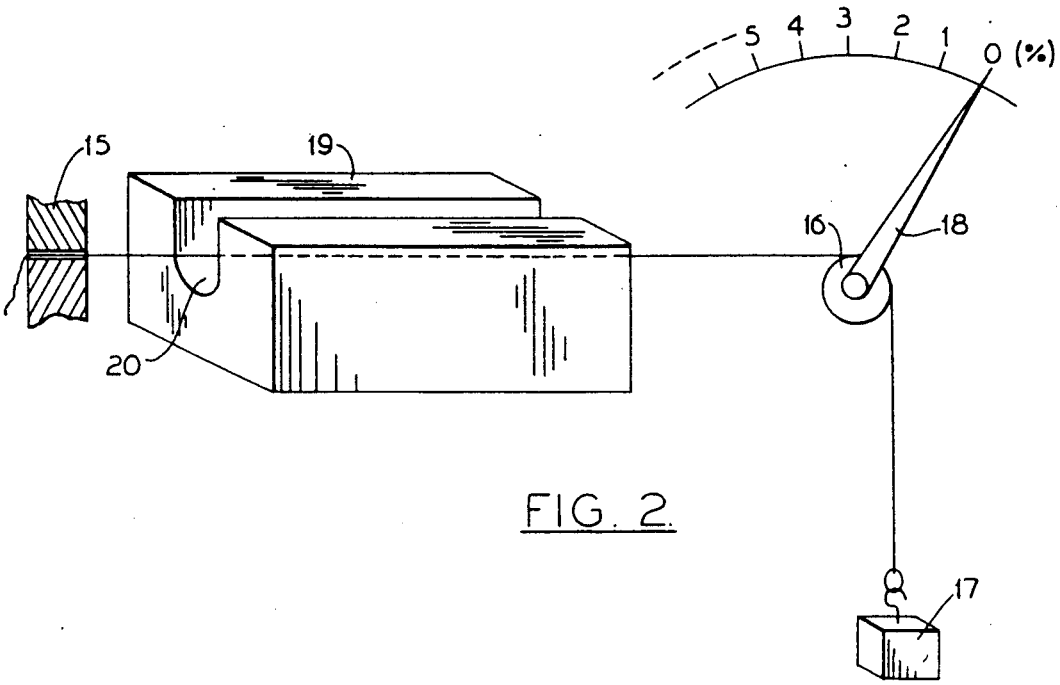
FIG. 2 is a schematic representation of a device for measuring the residual shrinkage of a yarn.

FIG. 2 illustrates a suitable apparatus for a quick measurement of the residual shrinkage. Such an apparatus is commercially available under the trademark TESTRITE TM . This instrument is used especially for comparative tests, and allows the percentage ($L1-L2$: $L1\times100$) to be determined, by which a pretreated yarn shrinks, when it is subjected to a shrinkage treatment on the TESTRITE TM instrument at the same clamping length, at the same heating length, as well as under the same yarn tension.

The yarn is firmly secured at one end 15 and guided over a measuring roll 16 at the other end. Behind the measuring roll 16, the yarn is loaded by a weight 17. The measuring roll is connected with a needle 18, so that a change in the yarn length is indicated on a scale. The yarn is heated by a heater 19 with a yarn slot 20. It results from general testing principles that when a test is run, the treatment time, the clamping length of the yarn between clamp 15 and measuring roll 16, the length of the heater 19, the temperature of the heater 19, and the weight 17 remain constant.

Figure 3:
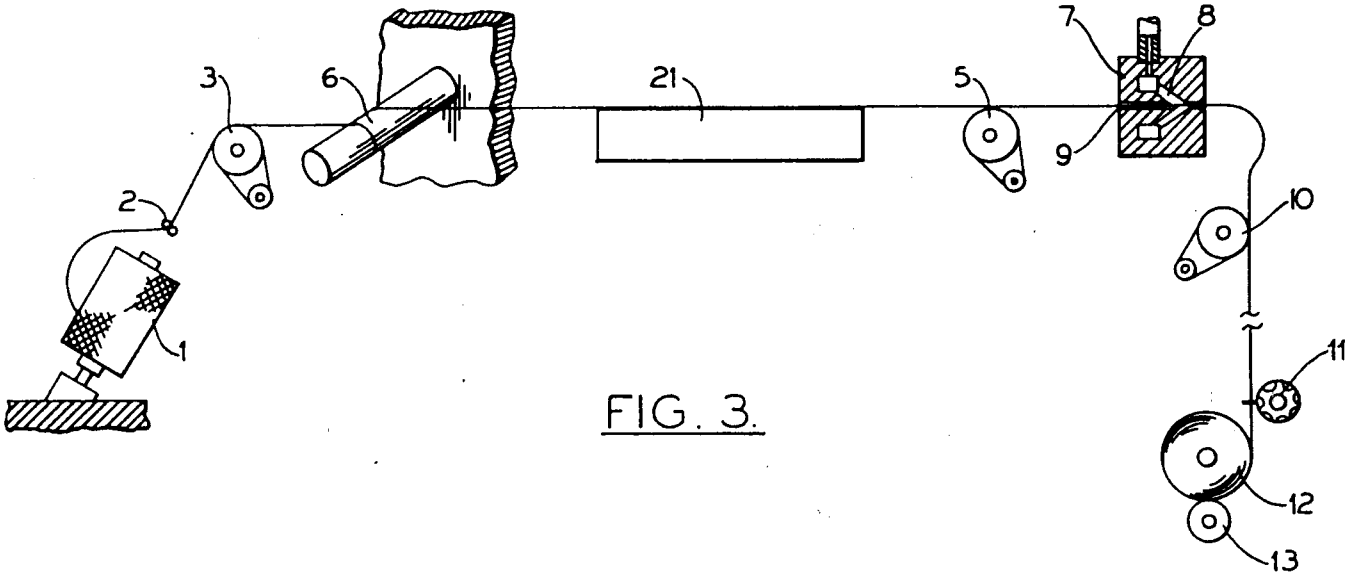
FIG. 3 is a schematic view of a second embodiment of an apparatus for conducting comparative tests of the present invention.

To conduct comparative tests, an apparatus as shown in FIG. 3 was used. In these tests, a polyethylene terephthalate yarn was drawn between the draw rolls 3 and 5 to a final denier of 167 dtex and then air textured. In the first instance, the drawing process occurred, as schematically indicated in FIG. 3, between the feed systems 3 and 5 in that the yarn was first guided over a hot pin 6 and then over a hot plate 21. The draw pin was heated to a temperature ranging from 90° to 120° C., and the hot plate had a temperature around 240° C. A yarn was produced with a strength of 4.11 cN/dtex, a breaking elongation of 12% and a TESTRITE TM residual shrinkage of 6% to 7%. In this test, however, the temperature control on the draw pin and the hot plate was very critical and a very careful adjustment of the temperatures was necessary. In comparison therewith, the method of the present invention, i.e. with the use of a heated draw roll in the place of a hot plate 21, permitted without difficulty a hot drawing with a heated draw pin despite the subsequent hot shrinkage treatment, as results from the following comparative test.

For a comparison, the same yarn was air textured in a processing sequence as shown in FIG. 1. This means that in the draw zone the yarn was guided only over the draw pin 6 heated to 140° C., but not over a hot plate. In its place, the godet 5 was heated to a temperature of 240° C. The yarn was looped about the godet so many times that it resulted in a heated yarn length of 1 meter. The yarn was withdrawn from the heated godet by the air texturing nozzle under a tension of 6 cN and then drawn off from the zone of the air texturing nozzle by the feed system 10 at a correspondingly reduced speed and with a tensile force of 5 cN. An air textured yarn was thus produced, which had substantially the same strength values (breaking strength and breaking elongation) as the yarn produced by the conventional process. The TESTRITE TM shrinkage, however, was reduced to less than 1%.

Figure 4:
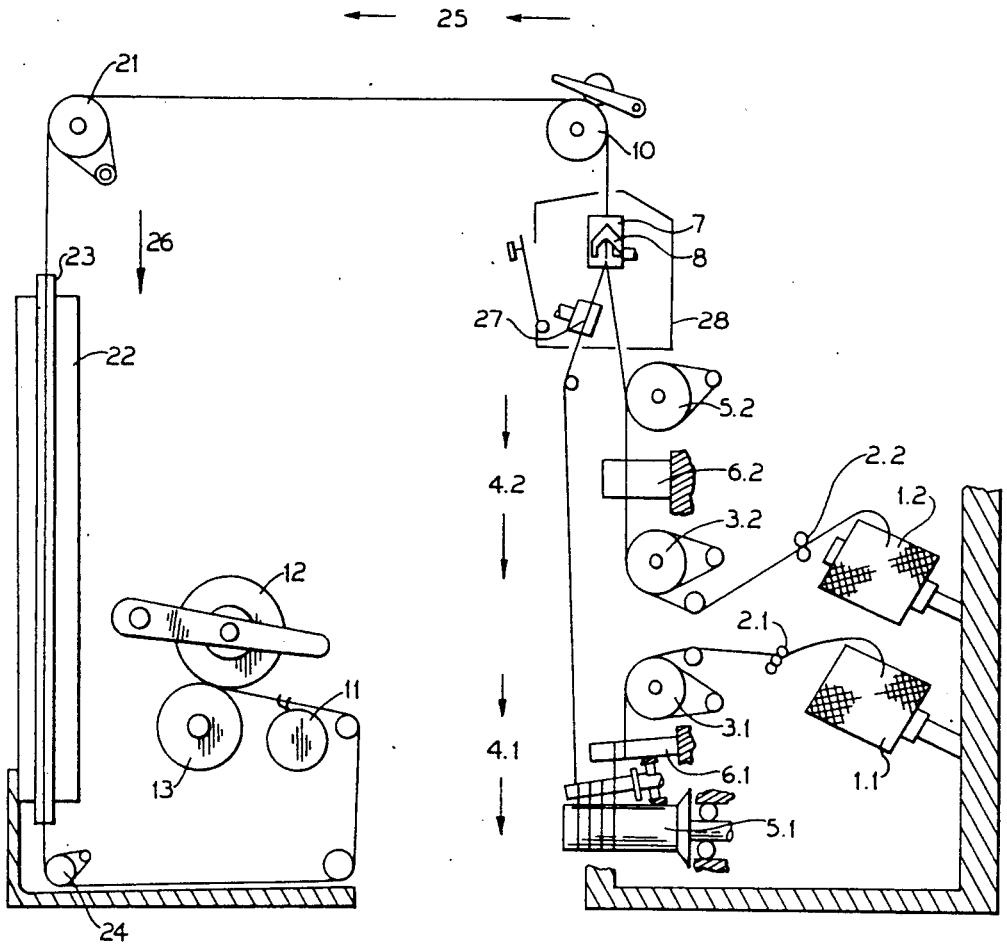
FIG. 4 is a schematic sectional view of an air texturing machine which embodies the present invention.

FIG. 4 is a schematic, cross sectional view of one position of a multi-position air texturing machine, which embodies the present invention. The special feature is that the use of the present invention permits a very simple design and construction of the draw zones and, consequently, a low overall height of the machine. The machine is provided with a creel for supply packages 1.1 and 1.2, on which a preoriented yarn is wound, such as polyester, in particular polyethylene terephthalate yarns. The yarns are unwound over yarn guides 2.1 and 2.2 by means of feed systems 3.1 and 3.2, and advance to draw zones 4.1 and 4.2. Each of the draw zones comprises respectively the aforesaid feed systems 3.1 or 3.2 and draw systems 5.1 or 5.2. The speeds of the feed systems 3.1, 3.2 and the draw systems 5.1 and 5.2 can be adjusted differently from each other. Consequently, it is possible to draw yarns at a different draw ratio. Special emphasis should be laid on the arrangement of the draw zones 4.1 and 4.2, which provide for an opposite direction of the yarn path, though, but are aligned one on top of the other. The two yarns advancing from their supply packages, pass between the two draw zones and then move on to their respective feed system 3.1 or 3.2. While the one yarn advances from feed system 3.1 downwardly over a draw pin 6.1 to the draw system 5.1, the other yarn moves from feed system 3.2 upwardly over draw pin 6.2 to draw system 5.2. For the purpose of drawing, each yarn loops about the draw pin 6.1 or 6.2 respectively by 360°. The draw pin 6.1 is cold, i.e., no heating system is provided to heat the draw pin. The draw pin 6.2 has a larger diameter and can be heated. The godet 5.1 is equipped with a heating system and can be heated to suitable temperatures up to 300° C. Suitable godets are disclosed, for example, in U.S. Pat. No. 3,435,171 and U.S. Pat. No. 3,487,187.

The illustrated yarn path has the advantage that the feed systems 3.1 and 3.2 are not in a very low location above the floor, which allows a simple threading of the yarn on these feed systems. However, another advantage is that the yarn leaving the heated godet 5.1 has a large distance to cover to the subsequent air texturing nozzle 7.

The two yarns advancing from the godets 5.1 and 5.2 respectively enter into the texturing nozzle 7, which is located above the draw zone 4.2. Prior to their entry, at least one of the yarns passes through a water nozzle 27, or is moistened in any other appropriate manner, for example, in a water bath. The water nozzle and air texturing nozzle are accommodated in a water box 28, which can be opened for servicing. The two yarns are joined in the air texturing nozzle 7, and an air jet is directed on the two yarns, which has a component in the direction of advance. By the impact of the air jet, the filaments of the two yarns are cooled, blended with each other and deformed to loops, curls, bows and the like. Since the speed of the draw systems 5.1 and 5.2 can be different, it is possible to guide the yarns into the air texturing nozzle at a different overfeed. This allows to produce effect yarns with very different properties.

The composite yarn produced in air texturing nozzle 7 is subjected to a drawing between a feed system 10 and another feed system 21, as is disclosed in U.S. Pat. No. 32,047. A stabilizing zone is arranged substantially horizontally above the operator aisle, since the feed system 10 on the one side and the feed system 21 on the other side of the operator aisle are located at the same height. The speed ratio of the feed systems 21 and 10 determines the ratio at which the composite yarn is drawn in the stabilizing zone 25. Also this drawing occurs within the elastic range and is not intended to lead to a plastic deformation of the yarn. The speed of the feed system 21 can be up to 15% higher than that of feed system 10.

Upon leaving the feed system 21, the composite yarn passes through the heated tube 23 of a heater 22. A feed system 24 withdraws the yarn from the setting zone 26. The heated tube 23 extends substantially vertically below the feed system 21, so that the yarn advances vertically from above to the bottom. The speeds of the feed systems 24 and 21 are so adapted that the withdrawal speed of feed system 24 is preferably somewhat lower, approximately 2% to 10%, than the speed of feed system 21. This allows to provide in the setting zone for another, controlled shrinkage of the yarn limited by the speed difference, if need be. Finally, the yarn is wound on package 12. The takeup system is arranged at a height favorable for the operator on the side of the heater 22, which faces the operator aisle.

The package is driven on its circumference by a friction roll 13 operating at a constant speed. Indicated at 11 is a yarn traversing mechanism. It is likewise possible to adjust the speeds for both the feed systems 21 and 24 and the friction roll 13 independently of each other. This allows different yarn tensions to be established in the stabilizing zone 25 and the setting zone 26. Further details are disclosed in the aforesaid U.S. Patent. It should be noted that the feed systems 10 and 21 can be driven at the same speed. In this case, no stabilization is needed. It is likewise possible to put the heater 22 out of operation. In this case, no heat setting will occur. The combination of stabilization in zone 25 and heat setting in zone 26, however, allows a yarn to be produced which is particularly well suited for further processing, and which also excels in good textile properties.

It should also be noted that the draw system 5.2 can be unheated or heated. If the godet 5.2 is heated, the draw pin 6.2 can likewise be unheated.

The aforesaid layout of the machine permits a low overall height. In particular, the feed systems 10 and 21 are located at such a height that they can be serviced from the floor. This is accomplished in that the draw zones 4.1 and 4.2 are each equipped only with godets and draw pins. It is also a special advantage that the yarn guided over the heated draw roll 5.1 has a long distance to reach the texturing nozzle, which gives it sufficient time to shrink before it is quenched in the texturing nozzle, which brings the shrinkage to a standstill.

The following table represents test results for the production of a textile and an industrial yarn. The measuring points I–IX indicated therein are shown in FIG. 1. The speeds of feed systems 3, 5 and 10 are indicated in percent so as to be in relation to each other. Indicated at measuring point VI of these tests are the yarn properties, residual shrinkage, and elongation before shrinkage or without shrinkage, and likewise at measuring point IX the same values with a shrinkage treatment according to the present invention. It shows that also with the use of a nonheated draw pin it is possible for both a textile and an industrial yarn to adjust to the required properties, although the draw process itself, i.e., without a residual shrinkage treatment, does not yet lead to usable yarn properties.

TABLE

| POY PES Measuring Point | Processing Variable | Textile Yarn | Industrial Yarn |
|---|---|---|---|
| I | Spinning denier | 410 dtex | 410 dtex |
| I | Yield point | 180% | 180% |
| II | Speed v3% | 100% | 100% |
| III | Yarn temperature | 80° C. | 130° C. |
| IV | Residual shrinkage at 177° C. | 10% | 12% |
| IV | Elongation E | 18% | 8% |
| IV | Spinning denier | 210 dtex | 178 dtex |
| V | Speed v5% | 195% | 230% |
| V | Temperature of draw roll T5 | 190° | 240° |
| VI | Yarn tension S1 | 7.0 cN | 6.8 cN |
| VII | Yarn tension S2 | 6.0 cN | 5.8 cN |
| VII | Yarn temperature | ≦40° C. | ≦40° C. |
| VIII | Overfeed | (7 + 20)% | (7 + 4)% |
| VIII | Speed v10 | 142% | 197.8% |
| IX | Residual shrinkage S (at 177° C.) | 1.8 | 2% |
| IX | Elongation | 25% | 14% |

In the drawings and specification, there has been set forth a preferred embodiment of the invention, and although specific terms are employed, they are used in a generic and descriptive sense only and not for purposes of limitation.

I claim:

1. A method of producing an air textured yarn having a relatively low residual shrinkage, and comprising the steps of advancing a continuous filament yarn along a path of travel, drawing the advancing yarn in a drawing zone positioned along said path of travel, and including guiding the advancing yarn into contact with a yarn engaging member and then about a positively rotated godet which serves to withdraw the advancing yarn from the yarn engaging member and draw the same, heating the godet so as to heat the yarn to a temperature which is higher than the second order transition temperature of the yarn, guiding the advancing yarn from said heated godet to an air jet nozzle while permitting the heated yarn to shrink and thereby reduce the residual shrinkage, applying a jet of unheated air to the advancing yarn while passing the advancing yarn through said air jet nozzle and so as to cool the yarn to a temperature below the second order transition temperature of the yarn, and to impart loops, curls, bows and the like to the cooled yarn, withdrawing the advancing yarn from said air jet nozzle, and then winding the advancing yarn into a package.

2. The method as defined in claim 1 wherein the heating step includes heating the yarn to a temperature above about 80 degrees C., and the step of applying a jet of unheated air to the yarn includes cooling the yarn to a temperature below about 40 degrees C.

3. The method as defined in claim 2 wherein the step of withdrawing the advancing yarn from the air jet nozzle includes withdrawing the same under a tension of less than about 0.08 cN/dtex.

4. The method as defined in claim 3 wherein the guiding step includes withdrawing the advancing yarn from the heated godet under a tension of less than about 0.1 cN/dtex, and the step of withdrawing the advancing yarn from said air jet nozzle includes withdrawing the same under a tension of less than about 0.05 cN/dtex.

5. The method as defined in claim 4 wherein the step of withdrawing the advancing yarn from the air jet nozzle comprises deflecting the advancing yarn immediately upon leaving said air jet nozzle by an angle of between about 30 to 90 degrees from its direction of travel through said air jet nozzle, and then engaging the deflected yarn with a rotating feed roll.

6. The method as defined in claim 1 wherein the yarn is a polyester yarn, and wherein the yarn engaging member is an unheated draw pin with the advancing yarn being looped thereabout at an angle of more then about 180 degrees, and wherein the drawing step serves to impart sufficient draw to exceed the yield point of the advancing yarn.

7. The method as defined in claim 1 further comprising the preliminary step of forming the advancing yarn by withdrawing the filaments of the yarn from a spinneret at a speed greater then about 2500 meters/min., and then delivering the resulting yarn to said drawing zone.

8. The method as defined in claim 1 wherein the step of applying a jet of air to the advancing yarn includes directing the jet of air so as impart a force to the yearn in the advancing direction, and wherein said godet is rotated at a speed so as to impart an overfeed to the advancing yarn during the advance of the yarn from said godet to said air jet nozzle.

9. The method as defined in claim 8 wherein said overfeed is between about 1 to 10% greater than the shrinkage imparted to the yarn in said air jet nozzle, and such that the produced yarn is adapted for industrial uses.

10. The method as defined in claim 8 wherein said overfeed is between about 10 to 300% greater than the shrinkage imparted to the yarn in said air jet nozzle, and such that the produced yarn is adapted for textile uses.

11. The method as defined in claim 1 wherein the step of applying a jet of unheated air to the advancing yarn includes cooling the yarn to an extent such that shrinkage comes to a standstill and the loops, curls, bows and the like are imparted without affecting the chemophysical structure of the yarn.

12. A method of producing an air textured yarn having a relatively low residual shrinkage, and comprising the steps of advancing a continuous filament yarn along a path of travel, drawing the advancing yarn in a drawing zone positioned along said path of travel, heating the yarn at a location adjacent the downstream end of said drawing zone and to a temperature which is higher than the second order transition temperature of the yarn, guiding the heated yarn from said drawing zone to an air jet nozzle while permitting the heated yarn to shrink and thereby reduce the residual shrinkage, applying a jet of unheated air to the advancing yarn while passing the advancing yarn through said air jet nozzle and so as to cool the yarn to a temperature below the second order transition temperature of the yarn, and to impart loops, curls, bows and the like to the cooled yarn, withdrawing the advancing yarn from said air jet nozzle, and then winding the advancing yarn into a package.

13. The method as defined in claim 12 wherein the step of applying a jet of unheated air to the advancing yarn includes cooling the yarn to an extent such that shrinkage comes to a standstill, and the loops, curls, bows and the like are thereafter mechanically imparted by contact of the air jet with the cooled yarn.

14. An apparatus for producing an air textured yarn having a relatively low residual shrinkage, and comprising means for withdrawing a yarn from a supply package and conveying the same along a path of travel, means positioned along said path of travel for drawing the advancing yarn, and including a yarn engaging member, a rotatable godet positioned downstream from said yarn engaging member, means for rotating said godet at a predetermined rotational speed, and means for heating said godet to a predetermined temperature, air jet nozzle means positioned along said path of travel downstream of said drawing means for applying a jet of unheated air to the advancing yarn so as to impart loops, curls, bows and the like to the advancing yarn, means for withdrawing the advancing yarn from said air jet nozzle, and means for winding the yarn withdrawn from said air jet nozzle into a package.

15. The apparatus as defined in claim 14 wherein said yarn engaging member of said drawing means comprises a fixed, unheated draw pin which is adapted to be looped by at least about 300 degrees by the advancing yarn.

16. The apparatus as defined in claim 14 wherein said drawing means and said air jet nozzle means are positioned in a vertically spaced apart relationship, and such that the yarn path of travel extends vertically therebetween.

17. An apparatus for producing an air textured yarn having a relatively low residual shrinkage, and comprising means for mounting a pair of yarn supply packages, first means for withdrawing a yarn from a first one of said supply packages and for drawing the withdrawn yarn, and including a first yarn engaging member, a first rotatable godet positioned downstream from said yarn engaging member, and means for rotating said first godet at a predetermined rotational speed, second means for withdrawing a yarn from a second one of said supply packages and for drawing the withdrawn yarn, and including a second yarn engaging member, a second rotatable godet positioned downstream from said second yarn engaging member, means for rotating said second godet at a predetermined rotational speed, means for heating at least one of said first and second godets to a predetermined temperature, air jet nozzle means positioned to receive both of the withdrawn yarns from the respective drawing means and for applying a jet of unheated air to the withdrawn yarns and so as to impart loops, curls, bows and the like thereto and form a composite yarn, means for withdrawing the composite yarn from said air jet nozzle, and means for winding the composite yarn withdrawn from said air jet nozzle into a package.

18. The apparatus as defined in claim 17 further comprising means for applying water to at least one of the withdrawn yarns just prior to its entry into said air jet nozzle means.

* * * * *